US010622744B2

(12) United States Patent
Kawakami

(10) Patent No.: US 10,622,744 B2
(45) Date of Patent: Apr. 14, 2020

(54) MULTIPOLE CONNECTOR

(71) Applicant: Molex, LLC, Lisle, IL (US)

(72) Inventor: Shota Kawakami, Yamato (JP)

(73) Assignee: Molex, LLC, Lisle, IL (US)

( * ) Notice: Subject to any disclaimer, the term of this patent is extended or adjusted under 35 U.S.C. 154(b) by 0 days.

(21) Appl. No.: 16/289,694

(22) Filed: Mar. 1, 2019

(65) Prior Publication Data

US 2019/0356073 A1 Nov. 21, 2019

(30) Foreign Application Priority Data

May 15, 2018 (JP) ..... 2018-093420

(51) Int. Cl.

| | |
|---|---|
| ***H01R 13/24*** | (2006.01) |
| ***H01R 12/71*** | (2011.01) |
| *H01R 12/70* | (2011.01) |
| *H01R 13/631* | (2006.01) |

(52) U.S. Cl.

CPC ..... *H01R 13/2435* (2013.01); *H01R 12/714* (2013.01); *H01R 12/7082* (2013.01); *H01R 13/631* (2013.01)

(58) Field of Classification Search

CPC .. H01R 23/70; H01R 13/2435; H01R 13/631; H01R 12/714; H01R 12/7082

USPC ..... 439/626

See application file for complete search history.

(56) References Cited

U.S. PATENT DOCUMENTS

| | | | | |
|---|---|---|---|---|
| 5,975,959 | A * | 11/1999 | Joly | G06K 7/0021 439/630 |
| 9,979,113 | B2 * | 5/2018 | Li | H01R 13/2457 |
| 2018/0358733 | A1 * | 12/2018 | Shimtosu | H01R 12/7082 |

FOREIGN PATENT DOCUMENTS

| | | | |
|---|---|---|---|
| JP | 2001-85131 | A | 3/2001 |
| JP | 2006-40658 | A | 2/2006 |
| JP | 2009-295515 | A | 12/2009 |
| JP | 5374510 | B2 | 12/2013 |

* cited by examiner

*Primary Examiner* — Abdullah A Riyami
*Assistant Examiner* — Nader J Alhawamdeh
(74) *Attorney, Agent, or Firm* — Molex, LLC

(57) ABSTRACT

A plurality of laterally extending modules aligned longitudinally orthogonal to the lateral direction with terminals attached to each module housing, each terminal including a longitudinally extended main body held in the module housing, a contact arm extending upward or downward from the main body, the contact arm including a contact portion contacting a counter terminal, a first bent portion connected to the main body and bent upward or downward, and a second bent portion formed between the contact portion and the first bent portion and bent in a direction opposite to the first bent portion.

9 Claims, 8 Drawing Sheets

Prior art

MULTIPOLE CONNECTOR

RELATED APPLICATIONS

This application claims priority to Japanese Application No. 2018-093420, filed on May 15, 2018, which is incorporated by reference in its entirety.

TECHNICAL FIELD

The present disclosure relates to a connector.

BACKGROUND ART

Conventionally, in order to connect a semiconductor device to a circuit board or to connect boards to each other, a multipole connector such as a pin grid array connector having a large number of terminals has been used (for example, see Patent Document 1).

FIG. 8 is a cross-sectional view of a terminal mounting section of a conventional connector.

In the figure, reference numeral 811 denotes a housing of the connector, the housing 811 being a plate-shaped member, made of an insulating material such as resin and having a plurality of openings 813. One terminal 861, made of metal, is accommodated in each opening 813. Each terminal 861 includes a flat plate-shaped engaging portion 862, and a pair of contact arms 863, of which the base ends connected to the engaging portion 862 are bent and the tips of which extend obliquely forward. The engaging portion 862 is sandwiched between a housing top side 811*a* and a housing bottom side 811*b*. One of the contact arms 863, among the pair of contact arms 863, extends obliquely upward and the other arm extends obliquely downward. A contact portion 864 is formed in the vicinity of the distal end of each contact arm 863 and the contact portion 864 contacts a contact pad on the surface of boards (not shown) disposed above and below the housing 811, causing the contact portions of the upper and lower circuit boards to electrically connect to each other.

Patent Document 1: Japanese Unexamined Patent Application Publication No. 2009-295515

SUMMARY

However, in the conventional connector, each contact arm 863 extends linearly in an obliquely upward direction or an obliquely downward direction, the contact arm 863 being connected to the engaging portion 862 so that the base end is bent with respect to the engaging portion 862. Therefore, when the contact portions 864 formed in the vicinity of the distal ends comes into contact with the contact pads of the upper and lower circuit boards thereby deforming the contact arms 863, stress concentrates in the vicinity of the proximal ends causing local damage or plastic deformation.

It is an object of the present disclosure to solve the above-mentioned conventional problems and provide a highly reliable connector in which stress generated in a terminal does not concentrate at one location, thereby preventing local damage or plastic deformation and reliably maintaining connection between the terminal and a counter terminal.

To achieve this, a connector is provided with a plurality of laterally extending module housings arranged side by side in a longitudinal direction, orthogonal to the lateral direction, and terminals attached to each module housing, each terminal having a main body held by the module housing and extending in the longitudinal direction, a contact arm extending upward or downward from the main body, a contact portion contacting a counter terminal, a first bent portion connected to the main body and bent upward or downward, and a second bent portion formed between the contact portion and the first bent portion and bent in a direction opposite to the first bent portion.

In another connector, each terminal further includes a single plate-shaped main body and a pair of elongated plate-shaped contact arms integrally connected to one end of the main body, one of the contact arms being an upper arm extending upwardly from the main body and the other contact arm being a lower arm extending downwardly from the main body.

In still another connector, each of the module housings includes a plurality of terminal holding blocks arranged side by side in the lateral direction and a pair of coupling blocks disposed at both ends in the lateral direction, wherein each terminal holding block, holding the main body of a terminal, and the coupling blocks are in contact with coupling blocks of longitudinally adjacent module housings.

In still another connector, each terminal holding block includes a block body, in which at least a portion of the main body of a terminal is embedded, and an upper arm passage recess and a lower arm passage recess, which are formed on the side of the block body.

In still another connector, the upper arm passage recess and the lower arm passage recess allow the upper arm and the lower arm of a terminal, held by another module housing adjacent to the rear side in the longitudinal direction, to pass therethrough.

In still another connector, the bottom face of the upper arm passage recess is an inclined surface inclined upward, and the bottom face of the lower arm passage recess is an inclined surface inclined downward.

According to the present disclosure, the stress generated in a terminal does not concentrate at one point thereby improving reliability by way of preventing local damage or plastic deformation from occurring and reliably maintaining the connection between the terminal and a counter terminal.

BRIEF DESCRIPTION OF DRAWINGS

FIGS. 2A and 2B are two-sided views of the connector, wherein FIG. 2A is a top view and FIG. 2B is a side view.

DETAILED DESCRIPTION OF THE PREFERRED EMBODIMENTS

Embodiments will be described in detail below with reference to drawings.

Figure 1:
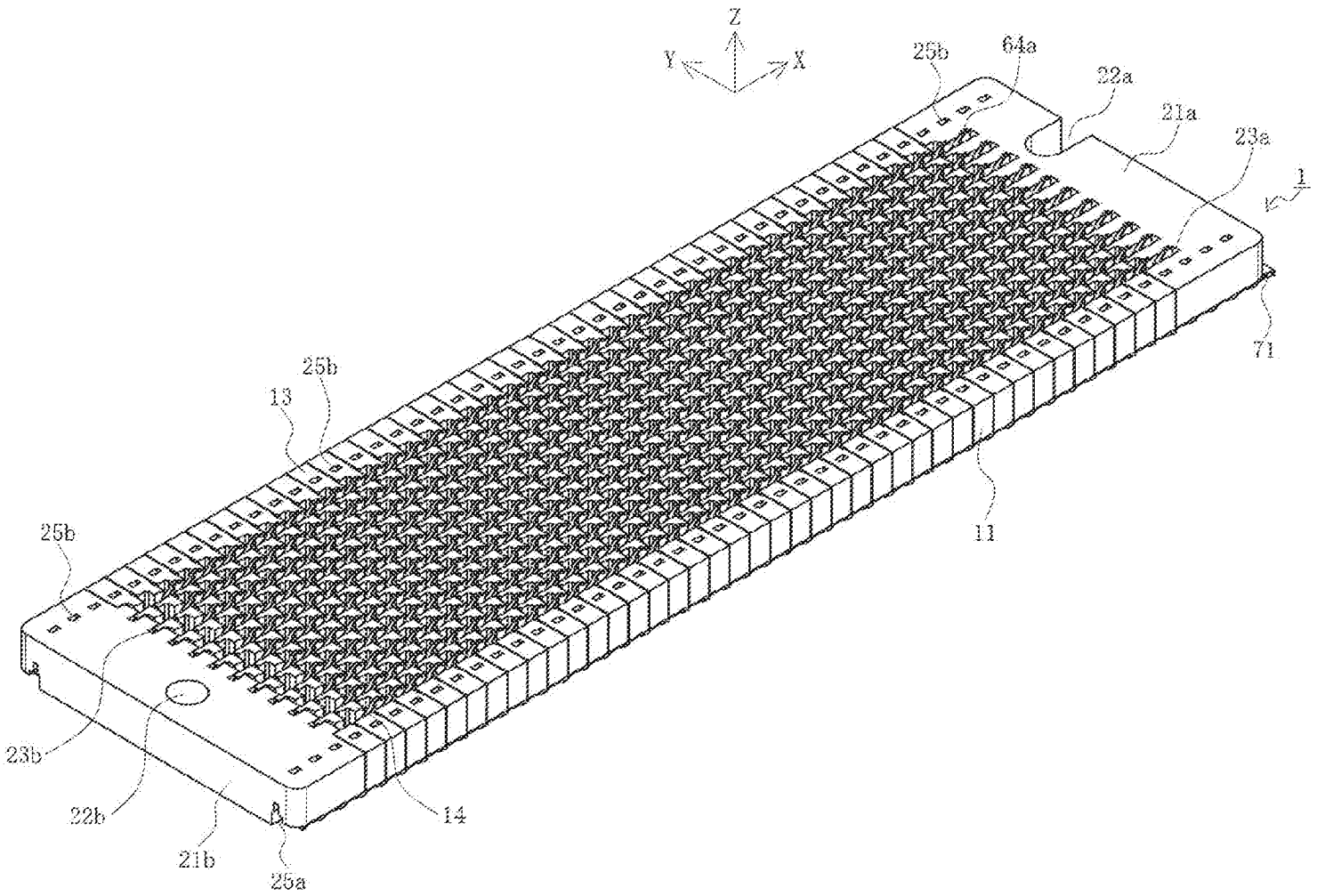
FIG. 1 is a perspective view of a connector according to an embodiment of the present disclosure
Figure 2A:
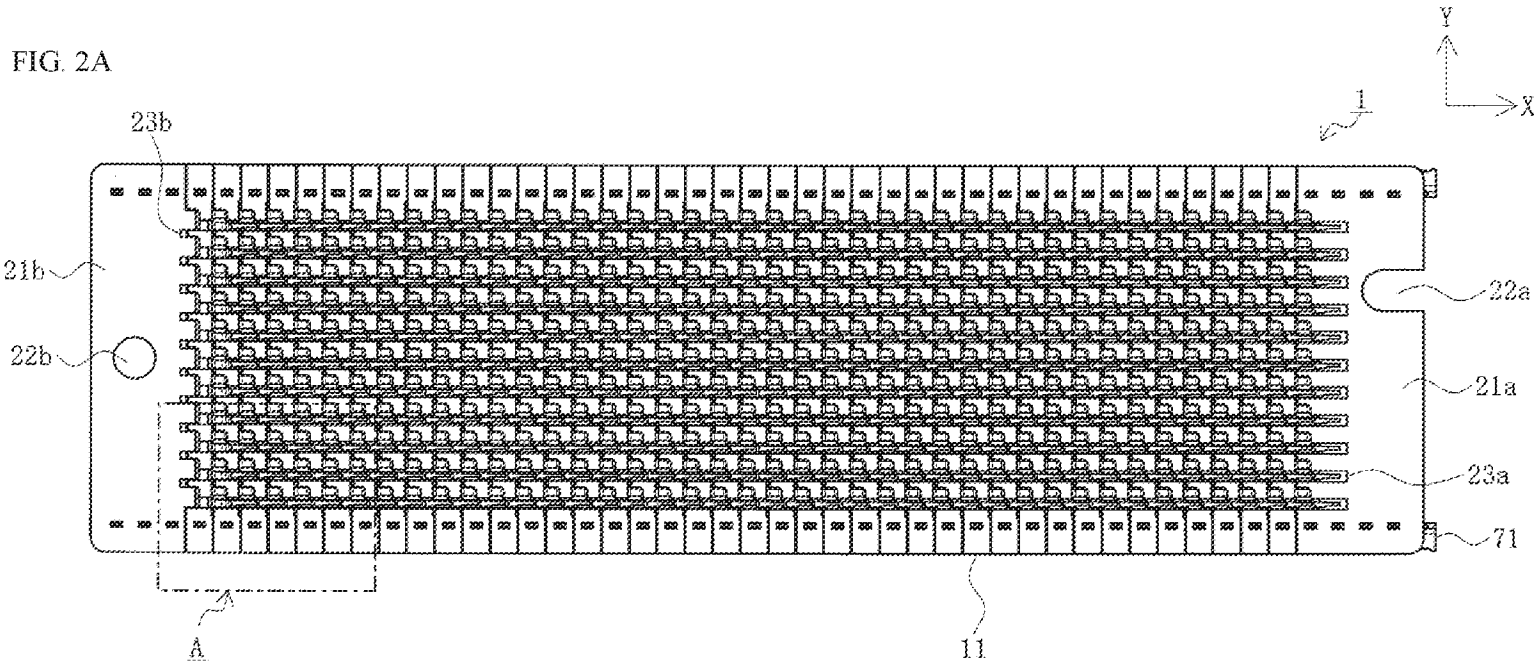
Figure 2B:
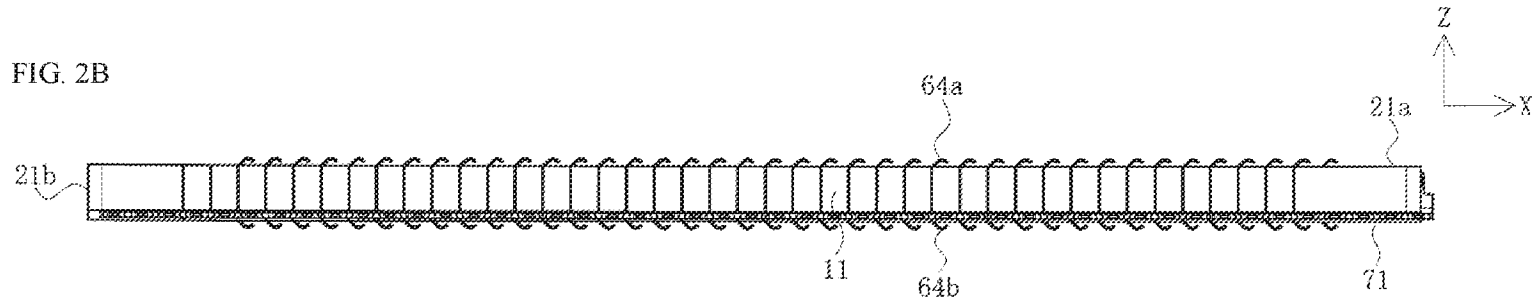
Figure 3:
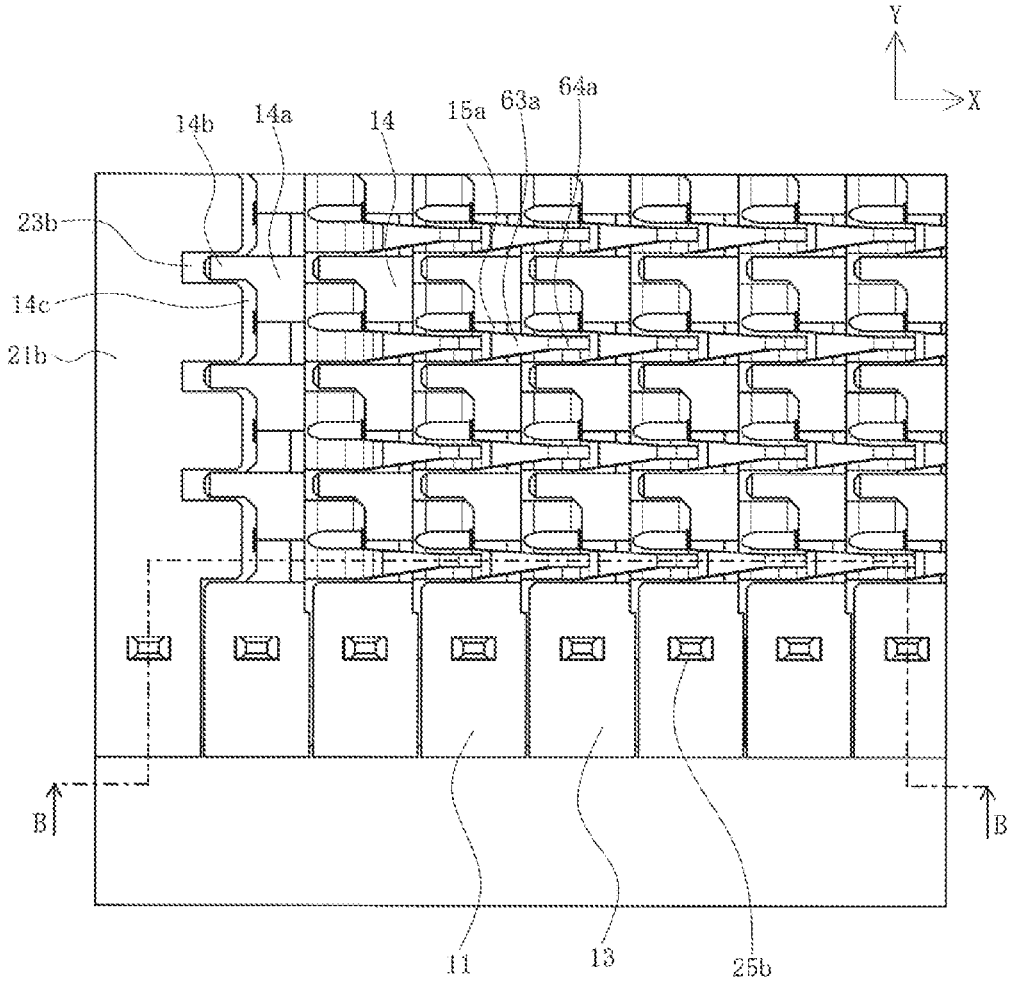
FIG. 3 is an enlarged view of a main part, that is, part A in FIG. 2A, of the connector
Figure 4:
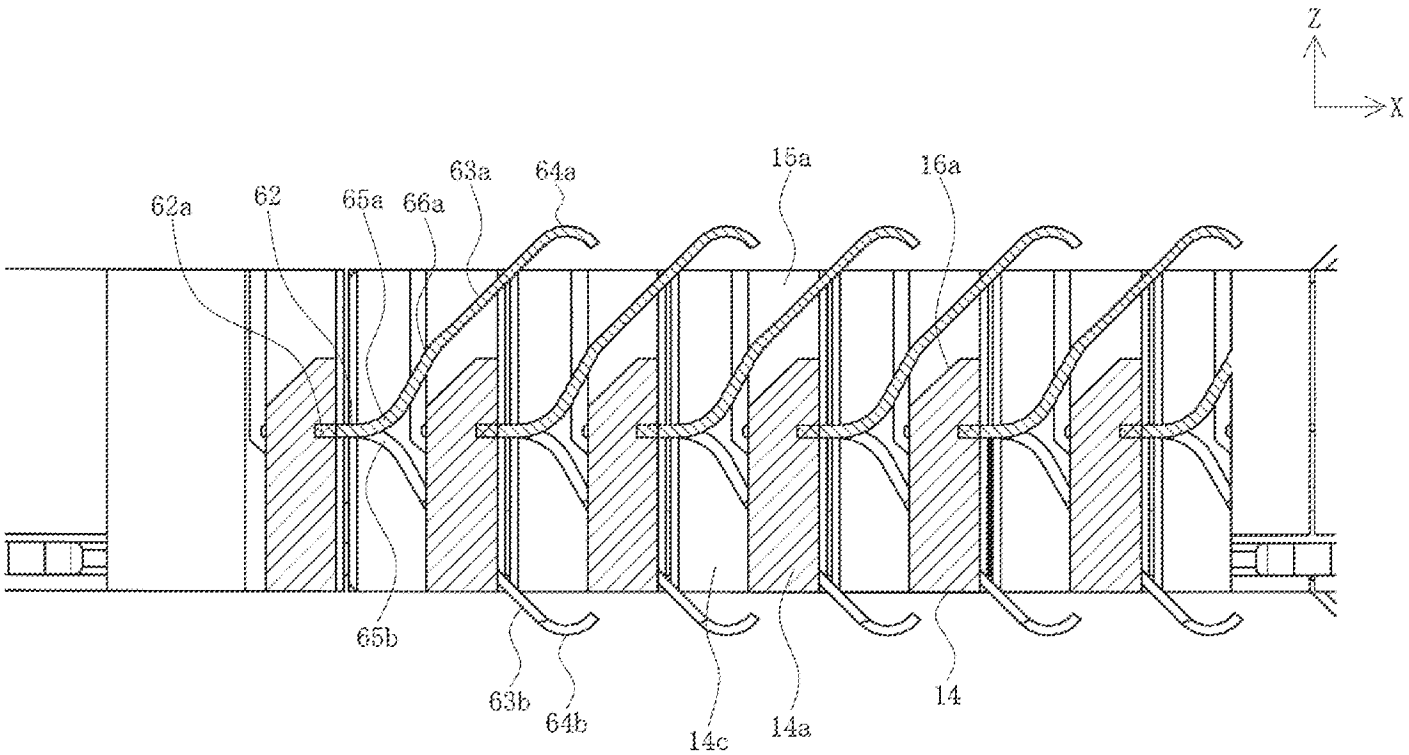
FIG. 4 is an enlarged cross-sectional view, taken along line B-B in FIG. 3, of a main part of the connector.
Figure 5:
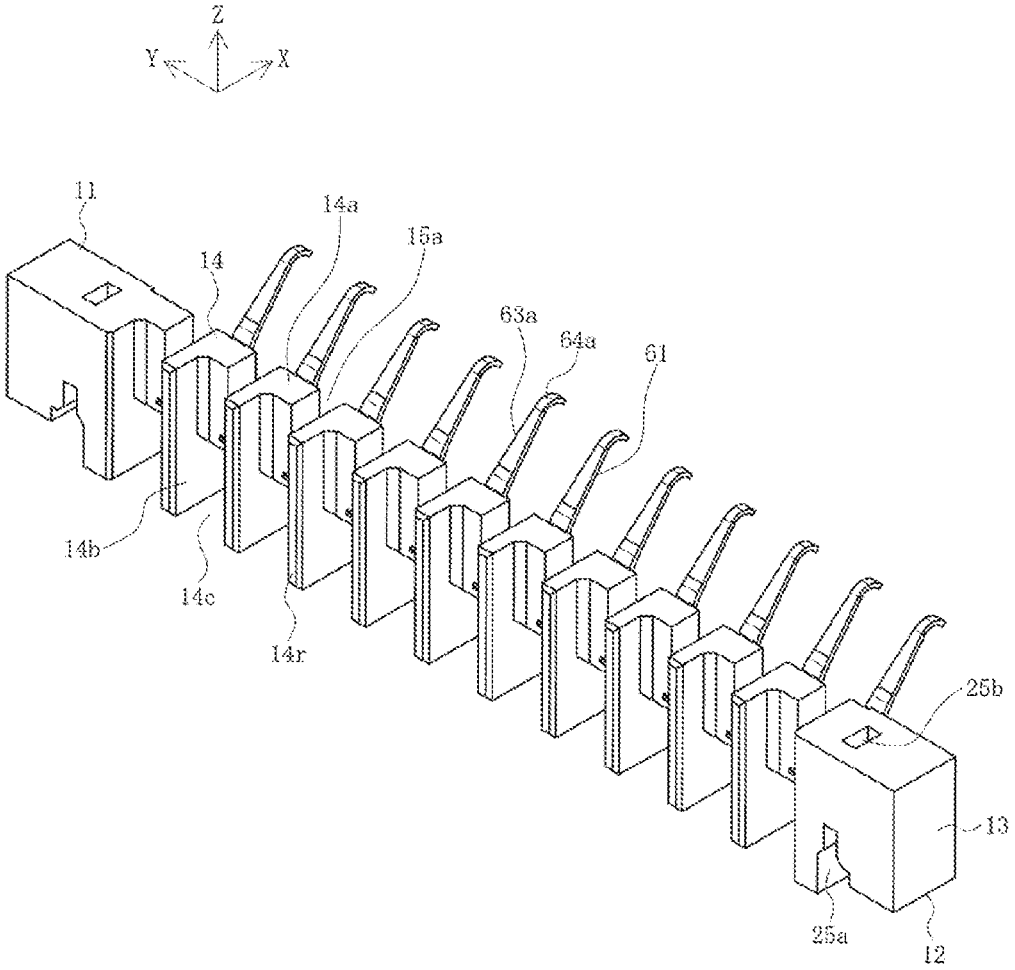
FIG. 5 is a rear perspective view of a module.
Figure 6:
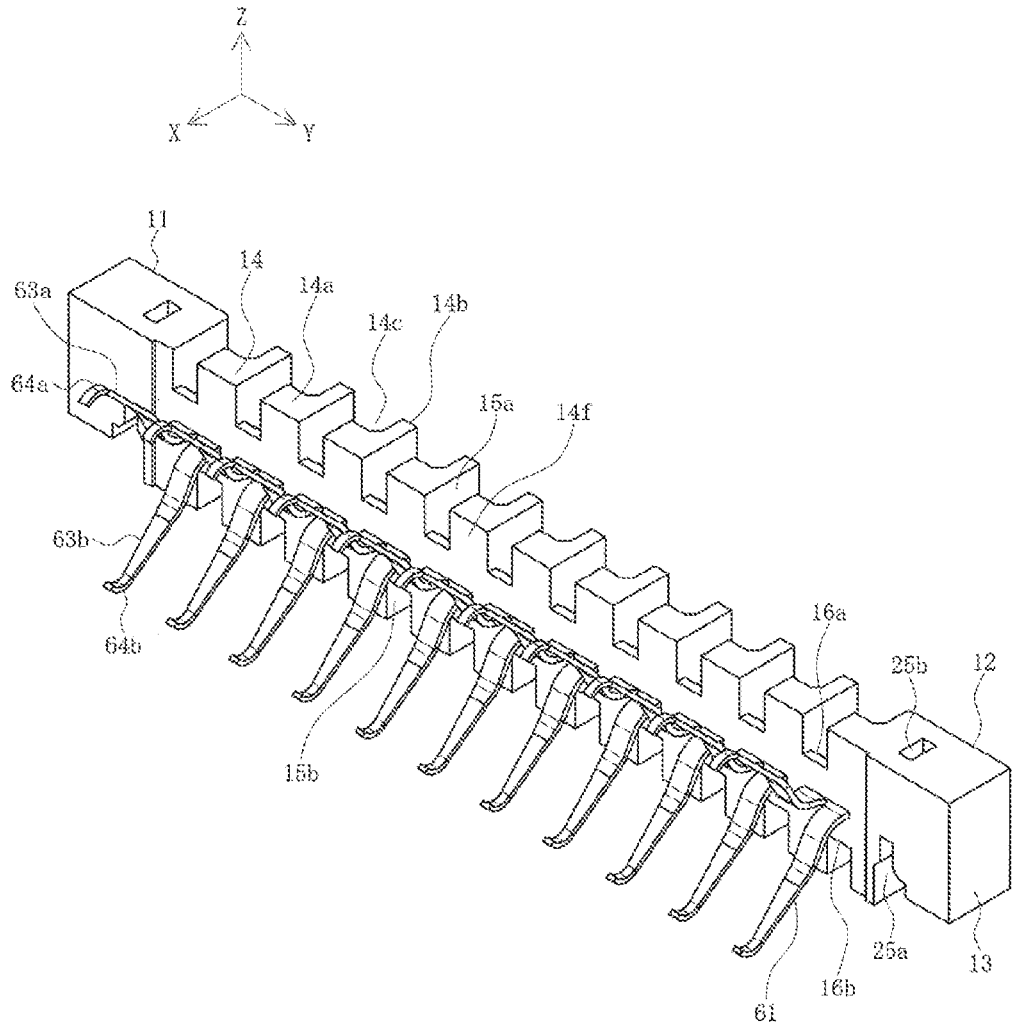
FIG. 6 is a perspective view of the module as seen from the front.
Figure 7:
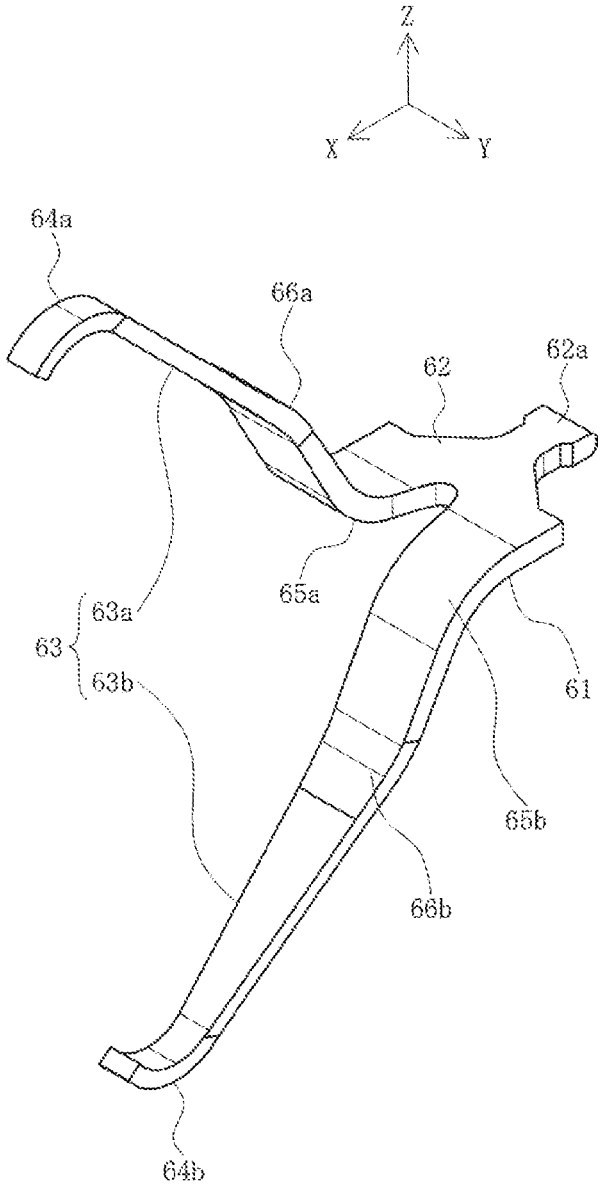
FIG. 7 is a perspective view seen from the front of a terminal.
Figure 8:
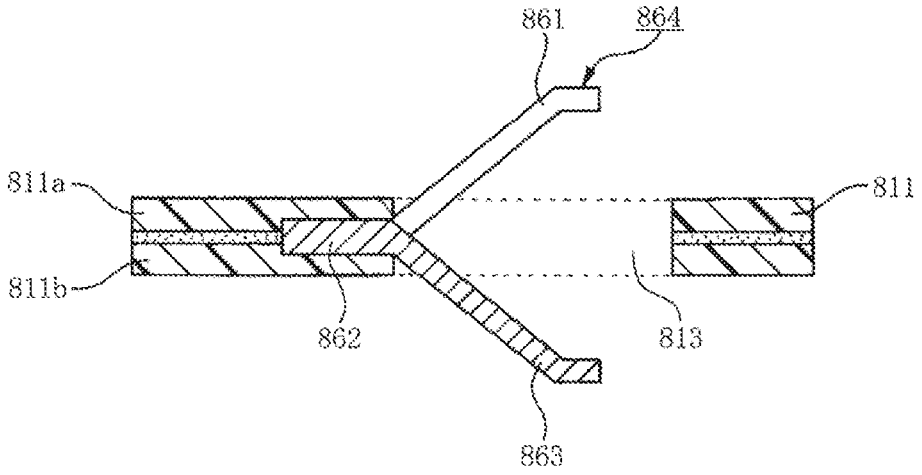
FIG. 8 is a cross-sectional view of a terminal mounting section of a conventional connector.

FIG. 1 is a perspective view of a connector according to an embodiment of the present disclosure; FIGS. 2A and 2B are two-sided views of the connector; FIG. 3 is an enlarged view, of part A in FIG. 2A, of the connector; FIG. 4 is an enlarged cross-sectional view, taken along line B-B in FIG. 3, of a main part of the connector; FIG. 5 is a rear perspective view of a module; FIG. 6 is a perspective view of the module as seen from the front; and FIG. 7 is a perspective view from the front of a terminal.

In the drawings, reference numeral 1 denotes a multipole connector of the present embodiment, which is a member having an overall thick rectangular flat plate-shaped shape and electrically connects a pair of circuit boards (not shown). The circuit board is, for example, a printed circuit board, a flexible flat cable, a flexible circuit board, or the like used in an electronic device or the like, but may be any type of board.

It should be noted that in the present embodiment, expressions indicating directions such as up, down, left, right, front, and rear, which are used to explain the configurations and operations of the respective parts included in the connector 1 and other members, are not absolute but relative and are appropriate when the respective parts included in the connector 1 and other members are in the orientation shown in the drawing but should be interpreted with changes in the orientation of respective parts included in the connector 1 and other members in accordance with changes in orientation.

The connector 1 includes a plurality of modules 11 arranged adjacent to each other in the longitudinal direction (i.e., the X-axis direction), a front housing portion 21*a* and a rear housing portion 21*b* as connector housings, and a pair of coupling members 71 for coupling the modules 11 to a front housing portion 21*a* or a rear housing portion 21*b*. Note that the number of modules 11 is not limited to the number shown in the drawings and may be changed as appropriate. The front housing portion 21*a* and the rear housing portion 21*b* are members having a thick flat rectangular plate-shaped shape integrally made of an insulating material such as synthetic resin. The coupling member 71 is an elongated member integrally made of a material having a relatively high strength such as metal and includes a body (not shown) in the form of an elongated thin plate extending in the X-axis direction and a plurality of projecting pieces (not shown) projecting upward (in the positive Z-axis direction) from the end of the upper side of the body.

Each module 11 includes an elongated module housing 12 integrally made of an insulating material such as synthetic resin and extending in the lateral direction (i.e., the Y-axis direction) and a plurality of terminals 61 integrally made of conductive and springy metal and attached to the module housing 12. The number of terminals 61 attached to each module housing 12 is not limited to the example shown in the drawings, and can be changed as appropriate. The module housing 12 and the terminal 61 are integrated as desired by a method called insert molding or overmolding, but may also be integrated by press fitting or the like.

The module housing 12 includes a plurality of terminal holding blocks 14 arranged in a row in the lateral direction (i.e., the Y-axis direction) and a pair of coupling blocks 13 disposed at both ends in the lateral direction (Y-axis direction). Each terminal holding block 14 holds one terminal 61. Adjacent terminal holding blocks 14 and coupling blocks 13 are integrally connected to each other. The coupling blocks 13 are in proximity contact with or abut against the coupling blocks 13 of longitudinally adjacent modules 11.

As shown in FIG. 7, the terminal 61 includes a flat plate-shaped main body 62, extending in the X-axis direction and the Y-axis direction, and a pair of elongated plate-shaped contact arms 63 extending forward (i.e., in the positive X-axis direction) from the front end of the main body 62, the terminal 61 having a substantially fork-shaped member in a planar (X-Y plane) view. One of the pair of contact arms 63 (located on the negative Y-axis side in the example shown in the drawing) is an upper arm 63*a* extending obliquely upward (i.e., in the positive X-axis direction and the positive Z-axis direction) and the other one of the pair of contact arms 63 (located on the Y-axis positive side in the example shown in the drawing) is a lower arm 63*b* extending obliquely downward (i.e., in the positive X-axis direction and the negative Z-axis direction). Therefore, the terminal 61 is a substantially rectangular or V-shaped member in the side view (i.e., the X-Z plane).

The main body 62 has a held portion 62*a* extending rearward (i.e., in the X-axis negative direction) from the rear end (i.e., the negative X-axis direction end), and the vicinity of the rear end of the main body 62 including the held portion 62*a* is embedded and held in the terminal holding block 14. Further, the distal end of the upper arm 63*a* is an upper contact portion 64*a*, curved to bulge upward, that is, curved downward, protruding upward from the upper surface of the module housing 12 and contacts a flat counter terminal disposed on the surface of the circuit board located above the connector 1, and the vicinity of the distal end of the lower arm 63*b* is a lower contact portion 64*b* curved to bulge downward, that is, curved upward, protruding downward from the lower surface of the module housing 12 and contacts with a flat counter terminal disposed on the surface of the circuit board located below the connector 1. Further, in the vicinity of the base end of the upper arm 63*a* extending obliquely upward, an upper first bent portion 65*a* is formed which is connected to the main body 62 and curved to bulge downward (i.e., curved upward), and in the vicinity of the base end of the lower arm 63*b* extending obliquely downward, a lower first bent portion 65*b* is formed which is connected to the main body 62 and curved to bulge upward (i.e., curved downward). Further, an upper second bent portion 66*a* curved to bulge upward (i.e., curved downward) is formed between the proximal end and the distal end of the upper arm 63*a* (i.e., between the upper first bent portion 65*a* and the upper contact portion 64*a*), and a lower second bent portion 66*b* curved to bulge downward (i.e., curved upward) is formed between the proximal end and the distal end of the lower arm 63*b* (i.e., between the lower first bent portion 65*b* and the lower contact portion 64*b*).

When the upper contact portion 64*a* and the lower contact portion 64*b* are described in an integrated manner, when the upper first bent portion 65*a* and the lower first bent portion 65*b* are described in an integrated manner, and when the upper second bent portion 66*a* and the lower second bent portion 66*b* are described in an integrated manner, they are described as the contact portion 64, the first bent portion 65, and the second bent portion 66, respectively.

Each terminal holding block 14 includes a block body 14*a*, a block wall 14*b* protruding rearward from the block body 14*a*, and a block recess 14*c*, at the rear of the block body 14*a*, between the block wall 14*b* and a block wall 14*b* of an adjacent terminal holding block 14. The rear-end vicinity of the main body 62 of the terminal 61, including the held portion 62*a*, is embedded in the block main body 14*a*, and the contact arm 63 extends forward from the front face 14*f* of the terminal holding block 14. In the terminal holding block 14, an upper arm passage recess 15*a* and a lower arm passage recess 15*b* are formed on the side of the block main body 14*a*. The upper arm passage recess 15*a* is a groove-shaped recess that is recessed downward from the upper end (i.e., the positive Z-axis direction end) of the terminal holding block 14 and penetrates the terminal holding block 14 in the X-axis direction, and is formed at the same Y-axis position as the upper arm 63*a*. The lower arm passage recess 15*b* is a groove-shaped recess that is recessed upward from the lower end (i.e., the negative Z-axis direction end) of the terminal holding block 14 and penetrates the terminal holding block 14 in the X-axis direction, and is formed at the same Y-axis position as the lower arm 63*b*. Further, an upper arm passing recess bottom face 16*a*, which is the bottom face of the upper arm passage recess 15*a*, is an inclined surface that rises forward, and the lower arm passage recess bottom face 16*b*, which is the bottom face of the lower arm passage recess 15*b*, is an inclined surface falls forward. When the upper arm passage recess 15*a* and the lower arm passage recess 15*b* are described in an integrated manner, and when the upper arm passage recess bottom face 16*a* and the lower arm passage recess bottom face 16*b* are described in an integrated manner, they are described as the arm passage recess 15 and arm passage recess bottom face 16, respectively.

When a plurality of modules 11 are arranged adjacent to each other in the longitudinal direction (i.e., the X-axis direction), an upper arm 63*a* and a lower arm 63*b* of a terminal 61, being provided with one or more modules 11 adjacent to the rear (i.e., the negative X-axis direction side) of the module 11, are capable of passing through the upper arm passage recesses 15*a* and the lower arm passage recesses 15*b*. In the example shown in the drawings, the upper arms 63*a* and the lower arms 63*b* of the two modules 11, being adjacent to the rear side of the module 11, are capable of passing through the upper arm passing recess 15*a* and the lower arm passing recess 15*b*. A portion of the main body 62 of the terminal 61 that is exposed from the front face 14*f* of the terminal holding block 14 is accommodated in the block recess 14*c* of the module 11 adjacent to the front side of the module 11. Further, the front face 14*f* of a terminal holding block 14 of a module 11 comes close to or abuts to the rear face 14*r* of a terminal holding block 14 of a module 11 adjacent to the front of the module 11.

The coupling block 13 has a coupling-member accommodating recess 25*a* and a positioning hole 25*b*. The coupling-member accommodating recess 25*a* is a recess that penetrates the coupling block 13 in the X-axis direction by being recessed upward from the lower end (i.e., the negative Z-axis direction end) of the coupling block 13, and accommodates the main body of the coupling member 71. The positioning hole 25*b* is a slit-shaped through hole extending from the upper end (i.e., in the positive Z-axis direction end) of the coupling block 13 to the upper end (not shown) of the coupling-member accommodating recess 25*a*, and one of the projecting pieces of the coupling member 71 of which main body is accommodated in the coupling-member accommodating recess 25*a*, is inserted and accommodated in the main body of the coupling block 13.

The front housing portion 21*a* also has a coupling-member accommodating recess 25*a* and a positioning hole 25*b*. The front housing portion 21*a* has a multiple number of positioning holes 25*b* (4 are shown in the example in the drawing).

In the front housing portion 21*a*, a terminal-arm accommodating recess 23*a* is formed at a position corresponding to the upper arm passage recess 15*a* and the lower arm passage recess 15*b* of the module 11 adjacent to the rear of the front housing portion 21*a*. The terminal-arm accommodating recess 23*a* is a groove-shaped recess which is recessed downward and upward from the upper end (i.e., the positive Z-axis direction end) and the lower end (i.e., the negative Z-axis direction end) of the front housing portion 21*a* and penetrates forward from the rear end (i.e., the negative X-axis direction end) of the front housing portion 21*a*, and the upper arm 63*a* and the lower arm 63*b* of the terminal 61 provided in the two to three modules 11 adjacent to the rear of the front housing portion 21*a* enter the front housing portion 21*a* and are accommodated.

Further, the front housing portion 21*a* has a connection positioning recess 22*a*. The connection positioning recess 22*a* is a groove-shaped recess penetrating rearward from the front end (i.e., the positive X-axis direction end) of the front housing portion 21*a* and penetrates from the upper face to the lower face of the front housing portion 21 *a*. When the connector 1 connects a pair of circuit boards, a connection positioning rod (not shown) enters and engages with the connection positioning recess 22*a*, positioning the connector 1 with respect to the circuit board.

The rear housing portion 21*b* also has a coupling-member accommodating recess 25*a* and a positioning hole 25*b*. The rear housing portion 21*b* has multiple positioning holes 25*b* (three are shown in the example in the drawing).

The rear housing portion 21*b* has a connection positioning hole 22*b*. The connection positioning hole 22*b* penetrates from the upper face to the lower face of the rear housing portion 21*b*. When the connector 1 connects a pair of circuit boards, a connection positioning rod (not shown) enters and engages with the connection positioning hole 22*b*, positioning the connector 1 with respect to the circuit board.

In the rear housing portion 21*b*, a block wall accommodating recess 23*b* is formed at a position corresponding to the block wall 14*b* of the module 11 adjacent to the front side of the rear housing portion 21*b*. The block wall accommodating recess 23*b* is a groove-shaped recess penetrating rearward from the front end (i.e., the positive X-axis direction end) of the rear housing portion 21*b*, and the block wall 14*b* of the terminal holding blocks 14 included in the module 11 adjacent to the front side of the rear housing portion 21*b* enters the block wall accommodating recess 23*b* and is accommodated.

When the front housing portion 21*a* and the rear housing portion 21*b* are described in an integrated manner, they are described as housing portions 21.

Next, an operation of electrically connecting a pair of circuit boards using the connector 1 having the above-described configuration will be described.

The pair of circuit boards may be used for any application and may be any type of board. It is assumed that a plurality of flat counter terminals are disposed on the upper face of the circuit board located below the connector 1, that is, the face on the positive Z-axis direction side, and a plurality of flat counter terminals are also disposed on the lower face of the circuit board located above the connector 1, that is, the face on the negative Z-axis direction side. The number and arrangement of the counter terminals of the circuit board located below the connector 1 are the same as the number and arrangement of the lower contact portions 64*b* of the terminals 61 protruding below the lower surface of the module housing 12, and the number and arrangement of the counter terminals of the circuit board located above the connector 1 are the same as the number and arrangement of the upper contact portions 64 *a* of the terminals 61 protruding above the upper surface of the module housing 12. Further, a pair of columnar connection positioning rods extending upward (i.e., the positive Z-axis direction) are attached to the circuit board located below the connector 1, and connection positioning rod accommodating holes (not shown) in which the upper ends of the connection positioning rods are accommodated are formed in the circuit board located above the connector 1.

The connector 1 is first placed on the upper face of the circuit board located below the connector 1. The connection positioning rod then enters and engages with the connection positioning recess 22*a* in the front housing portion 21*a* and the connection positioning hole 22*b* in the rear housing portion 21*b*, and the connector 1 is positioned with respect to the circuit board located below the connector 1. As a result, each lower contact portion 64*b* protruding downward from the lower face of the module housing 12 comes in contact with a corresponding counter terminal of the circuit board located below the connector 1.

Subsequently, the circuit board positioned above the connector 1 is placed on the upper face of the connector 1. The upper end of the connection positioning rod enters and engages with the connection positioning rod accommodating hole of the circuit board located above the connector 1, and the circuit board located below the connector 1 and the circuit board located above the connector 1 are positioned with respect to the connector 1. As a result, each of the upper contact portions 64*a* protruding upward from the upper face of the module housing 12 comes into contact with a corresponding counter terminal of the circuit board located above the connector 1.

Subsequently, the circuit board located below the connector 1 is pressed relatively downward. As a result, the connection between the pair of circuit boards with the connector 1 is completed, and each of the counter terminals of the circuit board located below the connector 1 is electrically connected to the corresponding counter terminal of the circuit board located above the connector 1 via the corresponding terminal 61.

The lower contact portion 64*b* projecting downward from the lower face of the module housing 12 is then pushed upward by the counter terminal of the circuit board located below the connector 1, and the upper contact portion 64*a* projecting upward from the upper face of the module housing 12 is pushed downward by the counter terminal of the circuit board located above the connector 1. Upon doing so, the lower arm 63*b* is elastically deformed displacing the lower contact portion 64*b* upward, and the upper arm 63*a* is elastically deformed displacing the upper contact portion 64*a* downward. Since the lower arm 63*b* includes a lower first bent portion 65*b*, bent downward and formed in the vicinity of the base end thereof, and a lower second bent portion 66*b*, bent upward and formed between the lower first bent portion 65*b* and the lower contact portion 64*b*, even if the lower contact portion 64*b* bent upward is deformed so as to be displaced upward, the stress generated in the lower arm 63*b* is dispersed without concentrating in one place. Similarly, since the upper arm 63*a* includes an upper first bent portion 65*a*, bent upward and formed in the vicinity of the base end thereof, and an upper second bent portion 66*a*, bent downward and formed between the upper first bent portion 65*a* and the upper contact portion 64*a*, even if the upper contact portion 64*a* bent downward is deformed so as to be displaced downward, the stress generated in the upper arm 63*a* is dispersed without concentrating in one place.

Therefore, neither the upper arm 63*a* nor the lower arm 63*b* is locally damaged or plastically deformed. Since both the upper arm 63*a* and the lower arm 63*b* function as a cantilever spring, both the upper contact portion 64*a* and the lower contact portion 64*b* can reliably maintain contact with the corresponding counter terminals.

Further, the upper contact portion 64*a* and the lower contact portion 64*b* which are displaced in directions approaching each other by the counter terminals are displaced relatively forward with respect to the counter terminal, thereby exerting a wiping effect from rubbing with the surface of the counter terminal.

Thus, the connector 1 in the present embodiment is a plurality of module housings 12 extending in the lateral direction arranged side by side in a longitudinal direction orthogonal to the lateral direction, comprising terminals 61 attached to each module housing 12, wherein each terminal 61 is held by a module housing 12 and includes a main body 62 extending in the longitudinal direction, and contact arms 63 extending upward or downward from the main body 62, each contact arm 63 including a contact portion 64 that comes in contact with a counter terminal, a first bent portion 65 connected to the main body 62 and bent upward or downward, and a second bent portion 66 formed between the contact portion 64 and the first bent portion 65 and bent in a direction opposite to the first bent portion 65.

As a result, even if the contact portion 64 is pushed by the counter terminal and the contact arm 63 is deformed, the stress generated in the contact arm 63 is dispersed without concentrating in one place, thereby preventing local damage or plastic deformation from occurring. Further, the contact portion 64 can be rubbed against the surface of the counter terminal, thereby exerting a wiping effect. As a result, the connection between the terminal 61 and the counter terminal can be reliably maintained, the structure is simple, the cost can be reduced, and reliability is improved.

Each terminal 61 includes a single plate-shaped main body 62 and a pair of elongated plate-shaped contact arms 63 integrally connected to one end of the main body 62, one of the contact arms 63 being an upper arm 63*a* extending upward from the main body 62, and the other contact arm 63 being a lower arm 63*b* extending downward from the main body 62. Further, each module housing 12 includes a plurality of terminal holding blocks 14 arranged side by side in the lateral direction, and a pair of coupling blocks 13 disposed at both ends in the lateral direction, and each terminal holding block 14 holds the main body 62 of each terminal 61, and the coupling blocks 13 are in contact with the coupling blocks 13 of other longitudinally adjacent module housings 12. Further, each terminal holding block 14 includes a block main body 14*a* in which at least a portion of the main body 62 is embedded, and an upper arm passage recess 15*a* and a lower arm passage recess 15*b* formed on the side of the block main body 14*a*. Further, the upper arm passage recess 15*a* and the lower arm passage recess 15*b* are capable of passing the upper arm 63*a* and the lower arm 63*b* of the terminal 61 held in another module housing 12 adjacent to the longitudinally rearward side. Further, the upper arm passage recess bottom face 16*a*, which is the bottom face of the upper arm passage recess 15*a*, is an inclined surface inclined upward, and the lower arm passage recess bottom face 16*b*, which is the bottom face of the lower arm passage recess 15*b*, is an inclined surface inclined downward.

Note that the disclosure of the present specification describes characteristics related to preferred and exemplary embodiments. Various other embodiments, modifications and variations within the scope and spirit of the claims appended hereto could naturally be conceived by persons skilled in the art by summarizing the disclosures of the present specification.

The present disclosure can be applied to connectors.

The invention claimed is:

1. A connector comprising:

a front housing portion;

a rear housing portion; and a plurality of modules arranged side by side, between the front and rear housing portions, in a longitudinal direction, each module being coupled to at least one of the front and rear housing portions, each module comprising a module housing and a plurality of terminals, wherein each module housing extends in a lateral direction, the lateral direction being orthogonal to the longitudinal direction, each module housing comprising a plurality of terminal holding blocks arranged in a row in the lateral direction, each module housing comprising first and second coupling blocks, the first coupling block being disposed at a first lateral end of the plurality of terminal holding blocks, the second coupling block being disposed at a second, opposite lateral end of the plurality of terminal holding blocks, and wherein one of the plurality of terminals comprises a main body and first and second contact arms, wherein the main body of each one of the plurality of terminals extends in the longitudinal direction and is attached to a respective one of the plurality of terminal holding blocks, wherein each of the first and second contact arms of each one of the plurality of terminals generally extend in the lateral direction toward the front housing portion, wherein the first contact arm of each one of the plurality of terminals generally extends upward in an up-down direction, the up-down direction being orthogonal to each of the longitudinal direction and the lateral direction, the first contact arm of each one of the plurality of terminals having an upper contact portion provided distal from the main body, a first bent portion provided proximate to the main body, and a second bent portion positioned between the upper contact portion and the first bent portion, the first bent portion being curved upwardly in the up-down direction, the second bent portion being curved downwardly in the up-down direction, and wherein the second contact arm of each one of the plurality of terminals generally extends downward in the up-down direction, the second contact arm of each one of the plurality of terminals having a lower contact portion provided distal from the main body, a first bent portion provided proximate to the main body, and a second bent portion positioned between the lower contact portion and the first bent portion, the first bent portion being curved downwardly in the up-down direction, the second bent portion being curved upwardly in the up-down direction.

2. The connector of claim 1, wherein the first and second coupling blocks of the module housing of one of the plurality of modules are in contact with the first and second coupling blocks of the module housing of an adjacent one of the plurality of modules.

3. The connector of claim 2, wherein each terminal holding block includes a block body in which at least a portion of the main body of the terminal is embedded, and an upper arm passage recess and a lower arm passage recess formed on a side of the block body.

4. The connector of claim 3, wherein the upper arm passage recess and the lower arm passage recess allow the first contact arm and the second contact arm of one of the terminals held in an adjacent and rearward one of the plurality of modules to pass therethrough.

5. The connector of claim 4, wherein a bottom face of the upper arm passage recess is an inclined surface inclined upward, and a bottom face of the lower arm passage recess is an inclined surface inclined downward.

6. The connector of claim 1, wherein each terminal holding block has a front face, and wherein the first and second contact arms of each terminal extend forward from the front faces of a respective one of the terminal holding blocks.

7. The connector of claim 6, wherein each terminal holding block has a rear face, and wherein the front face of one of the terminal holding blocks is configured to face the rear face of an adjacent one of the terminal holding blocks.

8. The connector of claim 7, wherein the front face of one of the terminal holding blocks is configured to abut the rear face of an adjacent one of the terminal holding blocks.

9. The connector of claim 1, wherein the upper contact portion of the first contact arm is curved downwardly in the up-down direction, and wherein the lower contact portion of the second contact arm is curved upwardly in the up-down direction.

* * * * *